US006732381B1

(12) United States Patent
Lal

(10) Patent No.: US 6,732,381 B1
(45) Date of Patent: May 11, 2004

(54) SPORTS HELMET

(76) Inventor: Sanjiv K. Lal, 46276 Ranchero Dr., Chilliwack BC (CA), V2R 5P3

( * ) Notice: Subject to any disclaimer, the term of this patent is extended or adjusted under 35 U.S.C. 154(b) by 128 days.

(21) Appl. No.: 10/068,931

(22) Filed: Feb. 8, 2002

(51) Int. Cl.[7] ..... A63B 71/10; A42B 1/24

(52) U.S. Cl. ..... 2/425; 2/422; 224/181; 455/575.2; 381/376

(58) Field of Search ..... 2/410, 209.13, 2/425, 422; 455/556.1, 557, 575.2, 569.1; 381/74, 77, 370, 374, 376; 700/94; 362/105, 106; 340/539.13; 224/181

(56) References Cited

U.S. PATENT DOCUMENTS

| | | | | | |
|---|---|---|---|---|---|
| 4,090,185 | A | * | 5/1978 | Patty | 340/321 |
| 4,321,433 | A | * | 3/1982 | King | 455/344 |
| 4,524,461 | A | * | 6/1985 | Kostanty et al. | 455/79 |
| 4,553,534 | A | * | 11/1985 | Stiegler | 601/15 |
| 4,607,395 | A | | 8/1986 | Sundahl | |
| 4,648,131 | A | * | 3/1987 | Kawaguchi et al. | 398/127 |
| 4,686,712 | A | * | 8/1987 | Spiva | 2/10 |
| 5,243,659 | A | * | 9/1993 | Stafford et al. | 381/86 |
| 5,552,772 | A | * | 9/1996 | Janky et al. | 340/573.4 |
| 5,689,558 | A | | 11/1997 | Osgood et al. | |
| D401,018 | S | | 11/1998 | Chartrand | |
| 5,953,434 | A | | 9/1999 | Boyden | |
| 6,006,115 | A | * | 12/1999 | Wingate | 455/575.2 |
| 6,009,563 | A | | 1/2000 | Swanson et al. | |
| 6,017,049 | A | * | 1/2000 | Spector | 280/288.4 |
| 6,061,306 | A | | 5/2000 | Buchheim | |
| 6,131,042 | A | * | 10/2000 | Lee et al. | 455/556.1 |
| 6,157,298 | A | * | 12/2000 | Garfinkel et al. | 340/479 |
| 6,497,493 | B1 | * | 12/2002 | Theisen | 362/105 |
| 6,527,416 | B1 | * | 3/2003 | Reason et al. | 362/259 |
| 6,546,264 | B1 | * | 4/2003 | Kennedy | 455/575.2 |
| 2001/0003542 | A1 | * | 6/2001 | Kita | 381/334 |
| 2002/0160723 | A1 | * | 10/2002 | Yagi | 455/90 |
| 2003/0071766 | A1 | * | 4/2003 | Hartwell et al. | 345/8 |

FOREIGN PATENT DOCUMENTS

| | | | | | |
|---|---|---|---|---|---|
| CH | 656997 | A5 | * | 7/1986 | H04B/5/02 |
| DE | 2547372 | A1 | * | 4/1977 | |
| FR | 2630603 | A1 | * | 10/1989 | A42B/3/02 |
| GB | 2290696 | A | * | 1/1996 | A42B/1/00 |
| JP | 62047295 | A | * | 2/1987 | H04Q/9/00 |
| JP | 07207512 | A | * | 8/1995 | A42B/3/30 |
| JP | 2001254218 | A | * | 9/2001 | A42B/3/30 |
| WO | WO 9402043 | A1 | * | 2/1994 | A42B/3/30 |

* cited by examiner

*Primary Examiner*—Rodney M. Lindsey

(57) ABSTRACT

A sports helmet for providing a user with a protective sports helmet that would include features such as an mp3 player, a radio, and a cellular telephone. The sports helmet includes a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

14 Claims, 4 Drawing Sheets

SPORTS HELMET

BACKGROUND OF THE INVENTION

1. Field of the Invention

The present invention relates to sports helmets and more particularly pertains to a new sports helmet for providing a user with a protective sports helmet that would include features such as an mp3 player, a radio, and a cellular telephone.

2. Description of the Prior Art

The use of sports helmets is known in the prior art. More specifically, sports helmets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 6,009,563; 6,157,298; 5,953,434; 5,689,558; U.S. Pat. No. Des. 401,018; U.S. Pat. Nos. 6,061,306; and 4,607,395.

While these devices fulfill their respective, particular objectives and requirements, the aforementioned patents do not disclose a new sports helmet. The inventive device includes a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

In these respects, the sports helmet according to the present invention substantially departs from the conventional concepts and designs of the prior art, and in so doing provides an apparatus primarily developed for the purpose of providing a user with a protective sports helmet that would include features such as an mp3 player, a radio, and a cellular telephone.

SUMMARY OF THE INVENTION

In view of the foregoing disadvantages inherent in the known types of sports helmets now present in the prior art, the present invention provides a new sports helmet construction wherein the same can be utilized for providing a user with a protective sports helmet that would include features such as an mp3 player, a radio, and a cellular telephone.

The general purpose of the present invention, which will be described subsequently in greater detail, is to provide a new sports helmet apparatus and method which has many of the advantages of the sports helmets mentioned heretofore and many novel features that result in a new sports helmet which is not anticipated, rendered obvious, suggested, or even implied by any of the prior art sports helmets, either alone or in any combination thereof.

To attain this, the present invention generally comprises a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sports helmet apparatus and method which has many of the advantages of the sports helmets mentioned heretofore and many novel features that result in a new sports helmet which is not anticipated, rendered obvious, suggested, or even implied by any of the prior art sports helmets, either alone or in any combination thereof.

It is another object of the present invention to provide a new sports helmet, which may be easily and efficiently manufactured and marketed.

It is a further object of the present invention to provide a new sports helmet, which is of a durable and reliable construction.

An even further object of the present invention is to provide a new sports helmet which is susceptible of a low cost of manufacture with regard to both materials and labor, and which accordingly is then susceptible of low prices of sale to the consuming public, thereby making such sports helmet economically available to the buying public.

Still yet another object of the present invention is to provide a new sports helmet, which provides in the apparatuses and methods of the prior art some of the advantages thereof, while simultaneously overcoming some of the disadvantages normally associated therewith.

Still another object of the present invention is to provide a new sports helmet for providing a user with a protective sports helmet that would include features such as an mp3 player, a radio, and a cellular telephone.

Yet another object of the present invention is to provide a new sports helmet, which includes a body member that is adapted for receiving a portion of the head of the user. The body member is adapted for protecting the head of the user from impacts. A strap assembly is coupled to the body member. The strap assembly is adapted for extending around a chin of the user for securing the body member to the head of the user. A communication assembly is coupled within the body member. The communication assembly is adapted for providing audio signals to the user when the body member is positioned on the head of the user.

Still yet another object of the present invention is to provide a new sports helmet that would eliminate the need to carry a separate sound system and wear a pair of loose headphones. The present invention would also prevent the user from forgetting to take their sound system along when he goes biking or skating.

Even still another object of the present invention is to provide a new sports helmet that would prevent the user from dropping an expensive sound system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
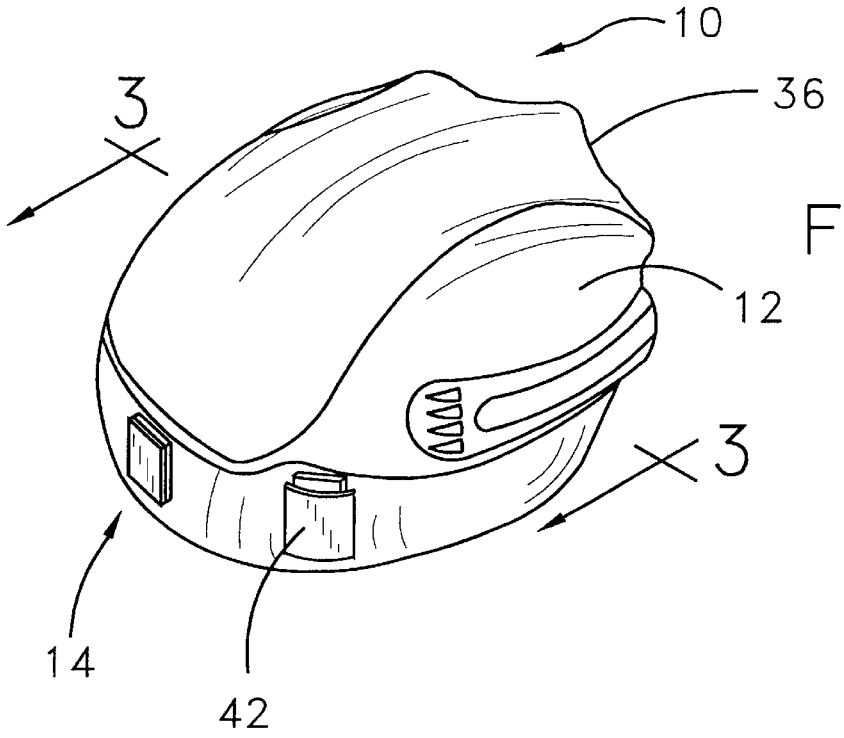
FIG. 1 is a perspective view of a new sports helmet according to the present invention.
Figure 2:
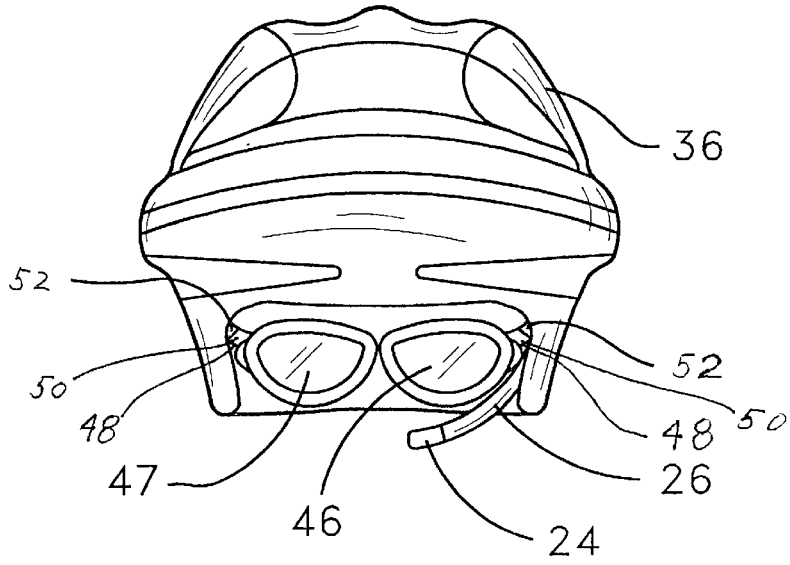
FIG. 2 is a front view of the present invention.
Figure 3:
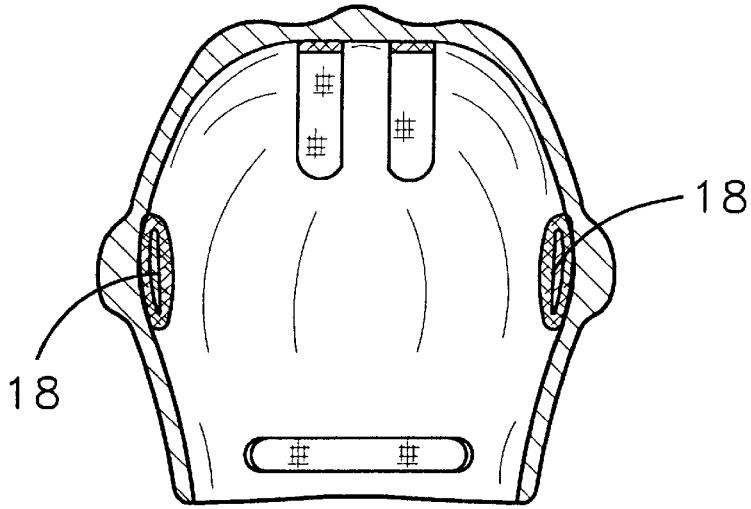
FIG. 3 is a cross-sectional view of the present invention.
Figure 5:
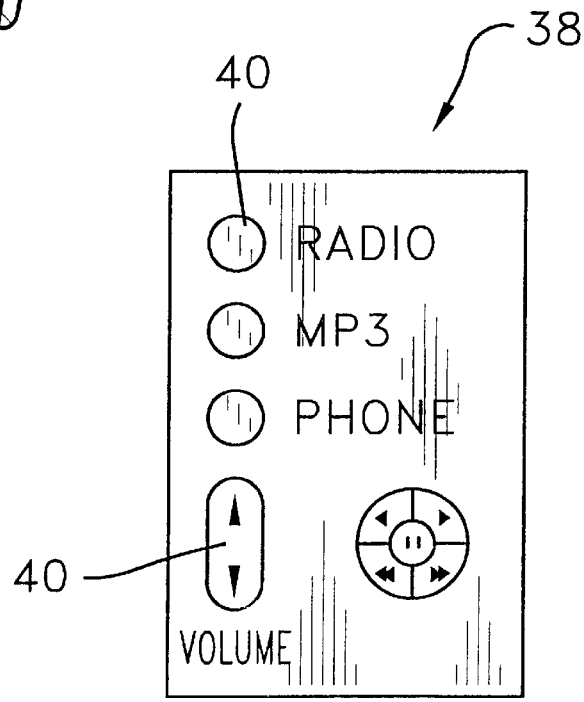
FIG. 5 is a front view of the remote control of the present invention.
Figure 4:
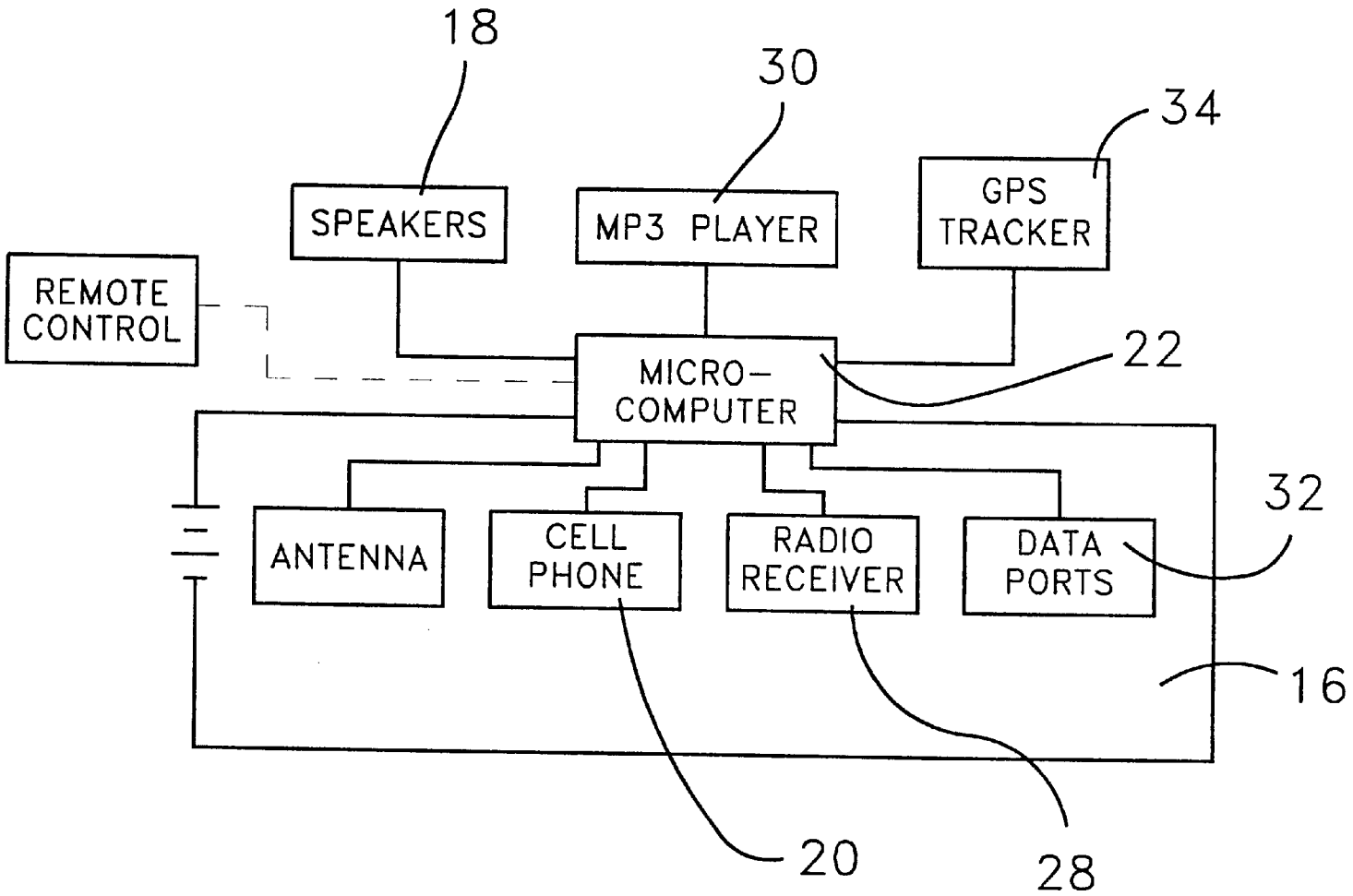
FIG. 4 is a block diagram of the present invention.
Figure 6:
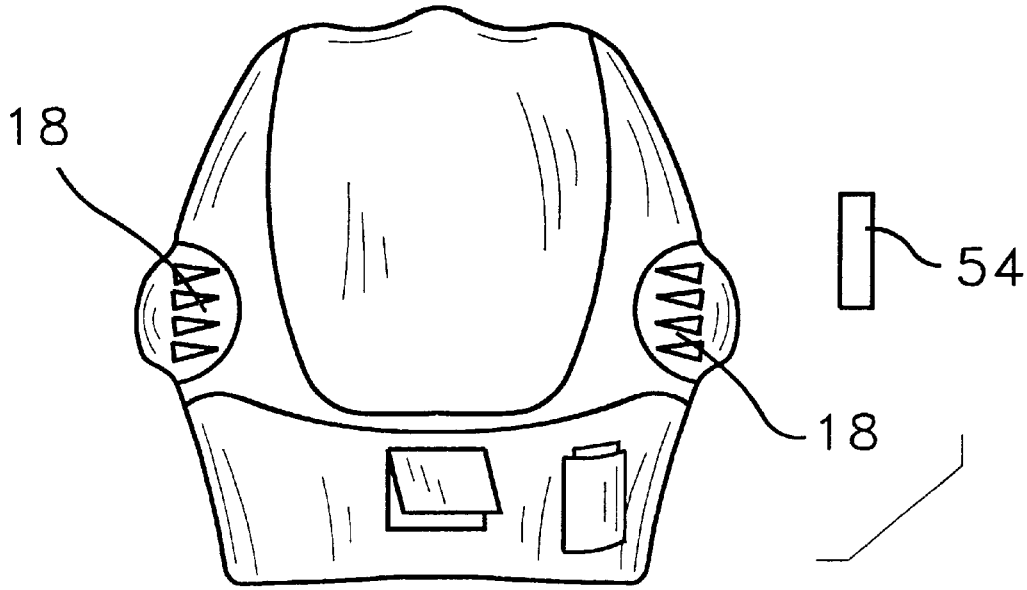
FIG. 6 is a rear view of the present invention.

With reference now to the drawings, and in particular to FIGS. 1 through 6 thereof, a new sports helmet embodying the principles and concepts of the present invention and generally designated by the reference numeral 10 will be described.

As best illustrated in FIGS. 1 through 6, the sports helmet 10 generally includes a body member 12 that is adapted for receiving a portion of the head of the user. The body member 12 is adapted for protecting the head of the user from impacts. Additionally a strap assembly may be coupled to the body member 12. The strap assembly is adapted for extending around a chin of the user for securing the body member 12 to the head of the user. A communication assembly 16 is coupled within the body member 12. The communication assembly 16 is adapted for providing audio signals to the user when the body member 12 is positioned on the head of the user.

The communications assembly 16 includes a plurality of speakers 18. Each of the speakers 18 are positioned within the body member 12 such that each of the speakers 18 is positioned adjacent an ear of the user. Each of the speakers 18 is adapted for audibly broadcasting the audio signals to the ears of the user.

The communications assembly 16 includes a phone assembly 20. The phone assembly 20 is operationally coupled to a processing assembly 22. The processing assembly 22 is operationally coupled to the speakers 18. The phone assembly 20 is adapted for receiving phone signals transmitted over free space such that the phone assembly 20 relays the phone signals to the processing assembly 22. The processing assembly 22 broadcasts the received phone signals through the speakers 18 for the user to hear.

The communication assembly 16 has a microphone 24. The microphone 24 is operationally coupled to the processing assembly 22. The microphone 24 is adapted for receiving verbal commands and communications from the user for the processing assembly 22 such that the microphone 24 is for controlling the phone assembly 20 when the microphone 24 receives verbal commands and the phone assembly 20 transmits verbal communications received by the microphone 24.

The microphone 24 has a boom arm 26. The boom arm 26 is selectively extendable from the body member 12 such that the microphone 24 is adapted for is positioned adjacent to a mouth of the user.

The communications assembly 16 has a radio assembly 28. The radio assembly 28 is operationally coupled to the processing assembly 22. The radio assembly 28 is adapted for receiving radio signals transmitted over freespace. The radio assembly 28 is adapted for transmitting the radio signals to the processing assembly 22 for broadcasting from the speakers 18. The processing assembly 22 is adapted for terminating broadcasting of the radio signals when the phone assembly 20 receives the phone signals. The microphone 24 is adapted for controlling the radio assembly 28 when the microphone 24 receives verbal commands from the user.

The communications assembly 16 has a player assembly 30. The player assembly 30 is operationally coupled to the processing assembly 22. The player assembly 30 is adapted for playing audio files. The player assembly 30 is adapted for transmitting the audio files to the processing assembly 22 for broadcasting from the speakers 18. The processing assembly 22 is adapted for terminating broadcasting of the audio files when the phone assembly 20 receives the phone signals. The microphone 24 is adapted for controlling the player assembly 30 when the microphone 24 receives verbal commands from the user.

The communications assembly 16 has at least one data port 32. The data port 32 is operationally coupled to the processing assembly 22. The data port 32 is adapted for selectively operationally coupling to a data source such that the data port 32 is adapted for transferring audio files to the player assembly 30.

The communications assembly 16 has a tracking assembly 34. The tracking assembly 34 is operationally coupled to a processing assembly 22. The tracking assembly 34 is adapted for receiving timing data from satellites for determining a location of the user. The processing assembly 22 is adapted for storing the timing data received by the tracking assembly 34 for recording a path taken by the user when the user is wearing the body member 12. The tracking assembly 34 is adapted for transmitting a tracking signal to be received by rescuers to guide the rescuers to your location.

The communications assembly 16 is positioned towards a rear of the body member 12. The body member 12 has a cover member 36. The cover member 36 is selectively positionable over the communications assembly 16 such that the cover member 36 is for protecting the communications assembly 16 from is damaged.

A remote assembly 38 has a plurality buttons 40. Each of the buttons 40 of the remote assembly 38 transmits a unique control signal over free space to the communication assembly 16 such that each unique control signal transmitted by the remote assembly 38 is for controlling one of a plurality of functions of the communications assembly 16.

The body member 12 has a pocket member 42. The pocket member 42 is coupled to an exterior surface of the body member 12. The remote assembly 38 is insertable between the pocket member 42 and the exterior surface of the body member 12 for selectively securing the remote assembly 38 to the body member 12 when the body member 12 is not in use by the user.

A goggle member 44 is selectively coupled to the body member 12. The goggle member 44 has a pair of eye portions 46. Each of the eye portions 46 is adapted for covering an eye of the user for protecting the eye of the user from is damaged by debris.

The goggle member 44 has a pair of ends 48. Each of the ends 48 of the goggle member 44 has a first fastener portion 50. The first fastener portion 50 of one of the ends 48 of the goggle member 44 is selectively couplable to one of a pair of second fastener portions 52 coupled to the body member 12 such that the goggle member 44 is secured to the body member 12.

A pointing assembly 54 is selectively coupled to the body member 12. The pointing assembly 54 is adapted for emitting a laser when the pointing assembly 54 is acutated by the user such that the laser is visible when the laser contacts an object. The pointing assembly 54 is adapted for guiding a rescuer to the location of the user when the laser contacts an object and is used to guide the user to the location of the user.

In use, the user would use the present invention just as a conventional sports helmet. The present invention would allow the user to make cellular phone calls, listen to the radio, and listen to favorite songs via the mp3 player. The user via wireless remote control would control the audio system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sports helmet for protecting a head of the user, the sports helmet comprising:

a body member being adapted for receiving a portion of the head of the user, said body member being adapted for protecting the head of the user from impacts;

a communication assembly being coupled within said body member, said communication assembly being adapted for providing audio signals to the user when said body member is positioned on the head of the users;

a remote assembly having a plurality buttons, each of said buttons of said remote assembly transmitting a unique control signal over free space to said communication assembly such that each unique control signal transmitted by said remote assembly is for controlling one of a plurality of functions of said communications assembly; and said body member having a pocket member, said pocket member being coupled to an exterior surface of said body member, said remote assembly being insertable between said pocket member and said exterior surface of said body member for selectively securing said remote assembly to said body member when said body member is not in use by the user.

2. The sports helmet as set forth in claim 1, further comprising:

said communications assembly comprising a plurality of speakers, each of said speakers being positioned within said body member such that each of said speakers is positioned adjacent an ear of the user, each of said speakers being adapted for audibly broadcasting said audio signals to the ears of the user.

3. The sports helmet as set forth in claim 2, further comprising:

said communications assembly comprising a phone assembly, said phone assembly being operationally coupled to a processing assembly, said processing assembly being operationally coupled to said speakers, said phone assembly being adapted for receiving phone signals transmitted over free space such that said phone assembly relays the phone signals to said processing assembly, said processing assembly broadcasting the received phone signals through said speakers for the user to hear.

4. The sports helmet as set forth in claim 3, further comprising:

said communication assembly having a microphone, said microphone being operationally coupled to said processing assembly, said microphone being adapted for receiving verbal commands and communications from the user for said processing assembly such that said microphone is for controlling said phone assembly when said microphone receives verbal commands and said phone assembly transmits verbal communications received by said microphone.

5. The sports helmet as set forth in claim 4, further comprising:

said microphone having a boom arm, said boom arm being selectively extendable from said body member such that said microphone is adapted for being positioned adjacent to a mouth of the user.

6. The sports helmet as set forth in claim 4, further comprising:

said communications assembly having a radio assembly, said radio assembly being operationally coupled to said processing assembly, said radio assembly being adapted for receiving radio signals transmitted over freespace, said radio assembly being adapted for transmitting the radio signals to said processing assembly for broadcasting from said speakers, said processing assembly being adapted for terminating broadcasting of the radio signals when said phone assembly receives the phone signals, said microphone being adapted for controlling said radio assembly when said microphone receives verbal commands from the user.

7. The sports helmet as set forth in claim 4, further comprising:

said communications assembly having a player assembly, said player assembly being operationally coupled to said processing assembly, said player assembly being adapted for playing audio files, said player assembly being adapted for transmitting the audio files to said processing assembly for broadcasting from said speakers, said processing assembly being adapted for terminating broadcasting of the audio files when said phone assembly receives the phone signals, said microphone being adapted for controlling said player assembly when said microphone receives verbal commands from the user.

8. The sports helmet as set forth in claim 7, further comprising:

said communications assembly having at least one data port, said data port being operationally coupled to said processing assembly, said data port being adapted for selectively operationally coupling to a data source such that said data port is adapted for transferring audio files to said player assembly.

9. The sports helmet as set forth in claim 1, further comprising:

said communications assembly having a tracking assembly, said tracking assembly being operationally coupled to a processing assembly, said tracking assembly being adapted for receiving timing data from satellites for determining a location of the user, said processing assembly being adapted for storing said timing data received by said tracking assembly for recording a path taken by the user when the user is wearing said body member, said tracking assembly being adapted for transmitting a tracking signal for being received by rescuers to guide the rescuers to your location.

10. The sports helmet as set forth in claim 1, further comprising:

said communications assembly being positioned towards a rear of said body member, said body member having a cover member, said cover member being selectively positionable over said communications assembly such that said cover member is for protecting said communications assembly from being damaged.

11. The sports helmet as set forth in claim 1, further comprising:

a goggle member being selectively coupled to said body member, said goggle member having a pair of eye portions, each of said eye portions being adapted for covering an eye of the user for protecting the eye of the user from being damaged by debris.

12. The sports helmet as set forth in claim 11, further comprising:

said goggle member having a pair of ends, each of said ends of said goggle member having a first fastener portion, said first fastener portion of one of said ends of said goggle member being selectively couplable to one of a pair of second fastener portions coupled to said body member such that said goggle member is secured to said body member.

13. The sports helmet as set forth in claim 1, further comprising:

a pointing assembly being selectively coupled to said body member, said pointing assembly being adapted for emitting a laser when said pointing assembly is acutated by the user such that said laser is visible when the laser contacts an object, said pointing assembly being adapted for guiding a rescuer to the location of the user when the laser contacts an object and is used to guide the rescuer to the location of the user.

14. A sports helmet for protecting a head of the user, the sports helmet comprising:

a body member being adapted for receiving a portion of the head of the user, said body member being adapted for protecting the head of the user from impacts;

communication assembly being coupled within said body member, said communication assembly being adapted for providing audio signals to the user when said body member is positioned on the head of the user;

wherein said communications assembly comprising a plurality of speakers, each of said speakers being positioned within said body member such that each of said speakers is positioned adjacent an ear of the user, each of said speakers being adapted for audibly broadcasting said audio signals to the ears of the user;

wherein said communications assembly comprising a phone assembly, said phone assembly being operationally coupled to a processing assembly, said processing assembly being operationally coupled to said speakers, said phone assembly being adapted for receiving phone signals transmitted over free space such that said phone assembly relays the phone signals to said processing assembly, said processing assembly broadcasting the received phone signals through said speakers for the user to hear;

wherein said communication assembly having a microphone, said microphone being operationally coupled to said processing assembly, said microphone being adapted for receiving verbal commands and communications from the user for said processing assembly such that said microphone is for controlling said phone assembly when said microphone receives verbal commands and said phone assembly transmits verbal communications received by said microphone;

wherein said microphone having a boom arm, said boom arm being selectively extendable from said body member such that said microphone is adapted for being positioned adjacent to a mouth of the user;

wherein said communications assembly having a radio assembly, said radio assembly being operationally coupled to said processing assembly, said radio assembly being adapted for receiving radio signals transmitted over free space, said radio assembly being adapted for transmitting the radio signals to said processing assembly for broadcasting from said speakers, said processing assembly being adapted for terminating broadcasting of the radio signals when said phone assembly receives the phone signals, said microphone being adapted for controlling said radio assembly when said microphone receives verbal commands from the user;

wherein said communications assembly having a player assembly, said player assembly being operationally coupled to said processing assembly, said player assembly being adapted for playing audio files, said player assembly being adapted for transmitting the audio files to said processing assembly for broadcasting from said speakers, said processing assembly being adapted for terminating broadcasting of the audio files when said phone assembly receives the phone signals, said microphone being adapted for controlling said player assembly when said microphone receives verbal commands from the user;

wherein said communications assembly having at least one data port, said data port being operationally coupled to said processing assembly, said data port being adapted for selectively operationally coupling to a data source such that said data port is adapted for transferring audio files to said player assembly;

wherein said communications assembly having a tracking assembly, said tracking assembly being operationally coupled to a processing assembly, said tracking assembly being adapted for receiving timing data from satellites for determining a location of the user, said processing assembly being adapted for storing said timing data received by said tracking assembly for recording a path taken by the user when the user is wearing said body member, said tracking assembly being adapted for transmitting a tracking signal for being received by rescuers to guide the rescuers to your location;

wherein said communications assembly being positioned towards a rear of said body member, said body member having a cover member, said cover member being selectively positionable over said communications assembly such that said cover member is for protecting said communications assembly from being damaged;

wherein a remote assembly having a plurality buttons, each of said buttons of said remote assembly transmitting a unique control signal over free space to said communication assembly such that each unique control signal transmitted by said remote assembly is for controlling one of a plurality of functions of said communications assembly;

wherein said body member having a pocket member, said pocket member being coupled to an exterior surface of said body member, said remote assembly being insertable between said pocket member and said exterior surface of said body member for selectively securing said remote assembly to said body member when said body member is not in use by the user;

wherein a goggle member being selectively coupled to said body member, said goggle member having a pair of eye portions, each of said eye portions being adapted for covering an eye of the user for protecting the eye of the user from being damaged by debris;

wherein said goggle member having a pair of ends, each of said ends of said goggle member having a first fastener portion, said first fastener portion of one of said ends of said goggle member being selectively couplable to one of a pair of second fastener portions coupled to said body member such that said goggle member is secured to said body member; and wherein a pointing assembly being selectively coupled to said body member, said pointing assembly being adapted for emitting a laser when said pointing assembly is acutated by the user such that said laser is visible when the laser contacts an object, said pointing assembly being adapted for guiding a rescuer to the location of the user when the laser contacts an object and is used to guide the rescuer to the location of the user.

* * * * *